US012617604B2

(12) United States Patent
Brivois

(10) Patent No.: US 12,617,604 B2
(45) Date of Patent: May 5, 2026

(54) CAPSULE FOR PREPARING A BEVERAGE

(71) Applicant: BRAIN CORP SA, Schifflange (LU)

(72) Inventor: Olivier Brivois, Differdange (LU)

(73) Assignee: Brain Corp S.A., Schifflange (LU)

( * ) Notice: Subject to any disclaimer, the term of this patent is extended or adjusted under 35 U.S.C. 154(b) by 852 days.

(21) Appl. No.: 17/621,754

(22) PCT Filed: Jun. 23, 2020

(86) PCT No.: PCT/EP2020/067532
§ 371 (c)(1),
(2) Date: Dec. 22, 2021

(87) PCT Pub. No.: WO2020/260300
PCT Pub. Date: Dec. 30, 2020

(65) Prior Publication Data

US 2022/0348402 A1 Nov. 3, 2022

(30) Foreign Application Priority Data

Jun. 24, 2019 (LU) ..... 101279
Feb. 3, 2020 (LU) ..... 101633

(51) Int. Cl.
*B65D 85/804* (2006.01)

(52) U.S. Cl.
CPC ..... *B65D 85/8064* (2020.05); *B65D 85/8043* (2013.01)

(58) Field of Classification Search
CPC ..... B65D 85/8064; B65D 85/8043; B65D 85/804
USPC ..... 99/295
See application file for complete search history.

(56) References Cited

U.S. PATENT DOCUMENTS 9,540,167 B2 * 1/2017 Zweed ..... B65D 85/8043
2010/0015307 A1 * 1/2010 Abegglen ..... B29C 45/14336 425/574
2016/0039601 A1 * 2/2016 Doglioni Majer .... A47J 31/407 426/112

(Continued)

FOREIGN PATENT DOCUMENTS

DE 202015100814 U * 7/2016 ..... B65D 86/8064
EP 1839543 A1 10/2007

(Continued)

OTHER PUBLICATIONS

International Search Report issued in corresponding application No. PCT/EP2020/067532, dated Jul. 16, 2020.

*Primary Examiner* — Reginald Alexander
(74) *Attorney, Agent, or Firm* — Harris Beach Murtha Cullina PLLC

(57) ABSTRACT

The invention relates to a capsule for containing a substance for preparing a beverage by placing the capsule in the cavity of a piston. The capsule has a body with a rim and a sealing ring which is attached to the lower wall of the rim. The sealing ring has an upper face bearing on the lower wall of the ring and a free lower face. The capsule has an inner bearing surface and an outer bearing surface each projecting from the rim forming a groove that is arranged to sealingly receive the peripheral edge of the piston during the preparation of the beverage. At least the outer bearing surface is formed on an inner wall of a ring and formed in one part on the free lower face of the sealing ring.

20 Claims, 7 Drawing Sheets

(56) References Cited

U.S. PATENT DOCUMENTS

| | | | | | |
|---|---|---|---|---|---|
| 2022/0073268 | A1 * | 3/2022 | Kamerbeek | ..... | B65D 85/8064 |

FOREIGN PATENT DOCUMENTS

| | | | | | |
|---|---|---|---|---|---|
| EP | 2966006 | A1 | | 1/2016 | |
| WO | 2006045515 | A2 | | 5/2006 | |
| WO | WO-2013046014 | A1 | * | 4/2013 | ..... A47J 31/00 |
| WO | WO-2013157924 | A1 | * | 10/2013 | ..... A47J 31/00 |
| WO | 2014118812 | A1 | | 8/2014 | |
| WO | 2015082982 | A1 | | 6/2015 | |
| WO | 2016186496 | A1 | | 11/2016 | |
| WO | 2018082982 | A1 | | 5/2018 | |
| WO | 2018185058 | A1 | | 10/2018 | |

* cited by examiner

CAPSULE FOR PREPARING A BEVERAGE

CROSS-REFERENCE TO RELATED APPLICATIONS

This application claims the benefit of International application number PCT/EP2020/067532, filed Jun. 23, 2020, Luxembourg patent application number 101279, filed on Jun. 24, 2019 and Luxembourg patent application number 101633, filed on Feb. 3, 2020, the entire contents of which are incorporated herein by reference.

TECHNICAL FIELD

The invention relates to a capsule intended for containing a substance for preparing a beverage.

It also relates to a system for preparing a beverage by using such a capsule, said system comprising a piston which has a cavity in which said capsule is intended to be placed to allow the preparation of said beverage.

BACKGROUND

Such capsules are intended in particular for the preparation of a hot beverage such as coffee, tea or an infusion. For this purpose, systems are known in which the cavity of the piston is fitted with a device which is arranged to inject under pressure an extracting liquid for the beverage, for example hot water, through said capsule and the substance contained therein, in particular by piercing said capsule by means of pins for injecting such a liquid provided for this purpose in said cavity.

During the preparation of a beverage, the piston device injects about 50 millilitres of extracting liquid into the cavity, and about 45 millilitres of this liquid are actually used for this preparation. Thus, following this injection, about 5 millilitres of extracting liquid remain in the cavity and may possibly leak out.

In order to limit the leakage of extracting liquid from the cavity, a capsule is known from documents EP-2 966 006 and EP-2 951 108 which has an upper rim with an upper wall on which a lid is intended to be attached after charging with the substance for preparing a beverage, as well as a lower wall which is fitted with a sealing structure comprising inner and outer crowns with a substantially triangular cross-section, between which a sealing lip extends, also of triangular cross-section.

Thus, when the capsule is placed in the cavity of the piston, the peripheral edge of said cavity is positioned between the outer and inner crowns, crushing the sealing lip, the combination of the piston, crowns and lip forming a sealing baffle for limiting leakages during the injection of the extracting liquid into the capsule.

In particular, the capsules described in these documents comprise a body made from a plastic material, and the sealing structure is formed in one piece with said body. Advantageously, the body is made by injection moulding a plastic material, which makes it possible to easily form the sealing structure at the same time as said body.

Since plastic materials can be relatively difficult to recycle it is desirable to limit their use.

For this purpose, capsules made of metal material are also known, in particular based on aluminium. These capsules have the advantage of being easy to manufacture, in particular by stamping a metal sheet, and also being easy to recycle, the metal forming the body being in particular recoverable by melting said body, once the residues of the substance that it contained have been extracted.

However, it is problematic to form a sealing structure as described above on such capsules, as the very fine dimensions of the crowns and the sealing lip do not allow them to be produced by stamping.

To overcome these disadvantages, document EP-1 816 935 describes a capsule, made in particular of aluminium, in which a silicone-based sealing ring is applied, in particular by moulding, onto the lower wall of the rim for receiving the lid. Thus, when the peripheral edge engages under the rim, it exerts local compression on a free lower face of the ring, which makes it possible to limit the leakage of liquid.

This solution poses a problem with regard to the recycling of the capsule. Indeed, before melting a used capsule to recover the aluminium, it is necessary to remove the silicone ring by burning it, as its mechanical extraction from said capsule is impossible to perform. However, as silicone is of petrochemical fossil origin, its combustion generates fine particles that are harmful to health and the environment.

Document EP-1 839 543 describes a capsule fitted with a ring made from an absorbent material, for example paper and/or cotton-based, said ring having a radial portion bearing on the lower wall of the rim and an axial-radial portion bearing around an upper portion of the lateral wall of the body.

However, this solution is also unsatisfactory, in that the sealing is achieved by deformation of the ring under the effect of pressure from the extracting liquid injected into the cavity at the time of preparing the beverage. Thus, there is still a significant risk of liquid leaking out of the cavity.

SUMMARY OF THE INVENTION

The objective of the invention is to improve the prior art by proposing in particular a capsule which is arranged to ensure a good seal of the cavity of the piston so as to avoid the leakage of the extracting liquid during its injection, at the same time being easily recyclable with limited impact on the environment.

For this purpose, according to a first aspect, the invention proposes a capsule intended to contain a substance for preparing a beverage by placing said capsule in the cavity of a piston, said capsule comprising a body having a lateral wall bordered on either side by a bottom and by a rim surrounding an opening of said body, said rim having a lower wall projecting laterally from said lateral wall, said capsule being fitted with a sealing ring which is attached to said lower wall and has an upper face bearing on said lower wall and a free lower face, said capsule having an inner bearing surface and an outer bearing surface, each projecting from the rim in an axial direction and forming therebetween a groove that is arranged to receive sealingly the peripheral edge of the piston during the preparation of the beverage, at least the outer bearing surface being formed in one piece on the free lower face of the sealing ring.

According to a second aspect, the invention proposes a system for preparing a beverage using such a capsule containing a substance for the preparation of said beverage, said system comprising a piston which has a cavity for receiving the capsule, said cavity comprising a device which is arranged to inject under pressure an extracting liquid of the beverage through said capsule, as well as a peripheral edge arranged to be placed in a sealing manner in the groove formed between the outer and inner bearing surfaces.

BRIEF DESCRIPTION OF THE DRAWINGS

Other features and advantages of the invention are given in the following description, made with reference to the attached Figures, in which.

DETAILED DESCRIPTION

Figure 1:
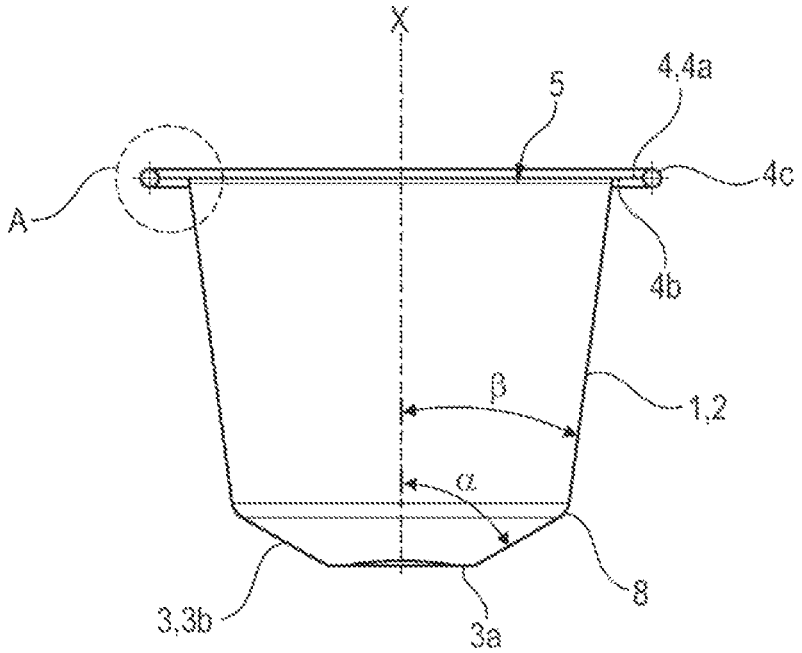
FIGS. 1 and 1*a* represent a capsule according to the invention, respectively in axial cross-section (FIG. 1) and according to an enlargement of area A of the FIG. 1 (FIG. 1*a*)

With reference to these Figures, a capsule intended for containing a substance for the preparation of a beverage is described below, as well as a system for the preparation of a beverage using such a capsule.

The capsule comprises a body 1 for containing such a substance, said body being preferably made from a metal material, in particular aluminium. Thus, the capsule can be easily manufactured, in particular by stamping, but also recycled, in particular by melting said body after extracting residues of the substance, in order to recover the aluminium for later use.

The body 1 has a geometry of revolution about a central axis X, with a lateral wall 2 bordered on either side by a bottom 3 and by a rim 4 surrounding an opening 5 of said body. In a known manner, the rim 4 comprises a smooth upper wall 4*a* to which a lid is intended to be attached, in particular by gluing, to cover the opening 5 after charging the substance into the capsule through said opening.

Figure 1A:
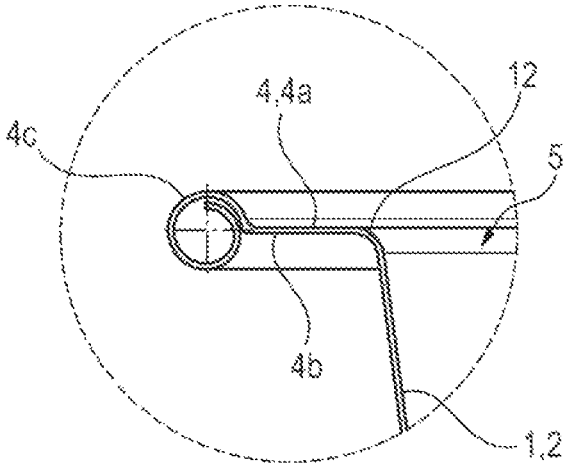

In the description, the terms "lower" and "upper" are defined in relation to the representation of the capsule in FIGS. 1, 1*a,* 4 and 4*a.* Furthermore, the terms "axial" and "radial" are defined in relation to the axis of revolution X, to denote a direction parallel and perpendicular to this axis X respectively.

In particular, the capsule is intended for the preparation of a hot beverage such as coffee, tea or an infusion. To achieve this, the system comprises a piston 6 which has a cavity 7 in which the capsule is intended to be placed, said cavity comprising a device (not shown) which is arranged for injecting under pressure an extracting liquid of the beverage through said capsule.

According to one embodiment, the cavity 7 comprises a bottom equipped with such an injection device, in particular in the form of pins arranged to pierce the bottom 3 of the capsule and inject the extracting liquid through said bottom. Furthermore, the upper lid is traversed by relief patterns provided on a base which is arranged opposite the cavity 7 for holding the capsule therein, in order to allow the beverage to flow out of said capsule. Such systems are described in particular in documents EP-1 839 543 and EP-1 816 935.

The body 1 is very thin, in particular with a thickness in the order of 0.1 mm, at least at the bottom 3, in order to make it easier for the injection pins to pierce it when preparing the beverage.

In the embodiments shown, the bottom 3 has a substantially radial lower portion 3*a,* as well as an upper portion 3*b* which is generally in the form of a truncated cone with a straight generatrix between said lower portion and the lateral wall 2. In particular, the upper portion 3*b* has an axial dimension in the order of 4 mm, forms an angle $\alpha$ in the order of 60° with the axis of revolution X, and is connected to the lateral wall 2 by a rounded transition 8 with a radius of curvature of between 0.7 and 1.5 mm.

In FIGS. 3, 4, 8*a* and 9*a,* the bottom 3 has indentations 9 with a circular base recessed on an outer wall of its upper portion 3*b,* distributed at equal angles around the axis X, said indentations being arranged to facilitate the piercing of the bottom 3 by pins for the injection of extracting liquid. In particular, the indentations 9 have a maximum depth in the order of 0.9 mm, and also a radius of curvature in the order of 1.5 mm.

The upper rim 4 also has a lower wall 4*b* projecting laterally from the lateral wall 2, the capsule being fitted with a sealing ring 10 which is attached to said lower wall by having an upper face 10*a* bearing on said lower wall and a free lower face 10*b* on which the peripheral edge 11 of the piston 6 is designed to come into contact when the capsule is placed in the cavity 7, in order to limit the leakage of liquid from said cavity.

In particular, the ring 10 can be joined to the rim 4 by being fixed onto the lower wall 4*b,* for example by means of an adhesive, by fusing or heat sealing. For this purpose, the ring 10 may comprise a fusible coating, in particular based on polyethylene, which is arranged on its upper face 10*a* to enable the joining of the ring 10 to the rim 4.

Alternatively, the ring 10 may be simply wedged onto the lower wall 4*b.*

According to another embodiment, the ring 10 comprises a self-adhesive strip which is arranged on its upper face 10*a* to enable the joining, in particular by pressure, of the ring 10 to the rim 4. In particular, the strip may have a first self-adhesive surface for joining to the ring 10 and an opposite self-adhesive surface for joining to the rim 4.

In the Figures, the rim 4 comprises a free end which is folded on itself to form a bead 4*c*, the ring 10 being set laterally between said bead and the lateral wall 2.

In particular, the rim 4 is connected to the lateral wall 2 by a rounded transition 12 with a radius of curvature of between 0.3 mm and 0.4 mm. Furthermore, the bead 4*c* has a substantially circular cross-sectional geometry, with a diameter in the order of about 1.3 mm.

The capsule has an inner bearing surface 13 and an outer bearing surface 14 each projecting from the rim 4 in an axial direction, forming therebetween a groove 15 which is arranged to sealingly receive the peripheral edge 11 of the piston 6 during the preparation of the beverage, at least the outer bearing surface 14 being formed in one piece on the free lower face 10*b* of the sealing ring 10.

Thus, the outer 14 and inner 13 bearing surfaces form with the peripheral edge 11 a sealing baffle which makes it possible to limit in a particularly reliable manner the leakage of extracting liquid from the cavity 7.

Advantageously, the sealing ring 10 is made from an absorbent material, in order to improve the sealing effect by absorbing quantities of liquid which pass through the aforementioned baffle. In particular, the ring 10 can be made from an absorbent paper-based material such as blotting paper, with a water absorption rate greater than or equal to 200 $ml/cm^3$ measured according to the Cobb method, as described for example in standard NF ISO 535.

The sealing ring 10 can also be made from a biodegradable and/or compostable material, in particular according to standard EN 13432, which makes it possible to improve the recycling of the capsule by limiting its impact on the environment.

According to one embodiment, the ring 10 is made from a cellulose-based material, in particular cardboard and/or paper, such a material having good properties in terms of liquid absorption and recycling.

In particular, the ring 10 can be made from a cardboard-based material with the following characteristics:

- a grammage of between 350 and 370 $g/m^2$, measured according to standard NF ISO 536;
- a total thickness, including a possible fusing coating, between 486 and 516 μm, measured according to standard NF ISO 534;
- a water absorption rate in the order of 30 $g/m^2$ for an exposure time of 60 seconds, measured according to the Cobb method, as described for example in standard NF ISO 535;
- a longitudinal bending moment of between 31.7 and 36.4 mNm and a transverse bending moment of between 13.2 and 15.2 mNm, measured according to the Taber method, as described in standard NF ISO 2493;
- a longitudinal tensile strength of between 28 and 28.5 kN/m and a transverse tensile strength of between 12.5 and 14 kN/m, measured according to standard NF ISO 1924-2;
- a longitudinal tearing strength of between 4900 and 5300 mN and a transverse tearing strength of between 5300 and 5800 mN, measured according to standard NF ISO 1974.

Advantageously, the ring 10 can be made from a material based on recycled cardboard and/or recycled paper, which makes it possible to further limit the pollution generated by the manufacture of the capsule.

At least one bearing surface 13, 14 may have a slope converging into the groove 15, so as to improve the guiding of the peripheral edge 11 in said groove. In particular, in FIGS. 2*a*, 2*b*, 5*a*, 5*b*, 6*a*, 6*b*, 7*a* and 7*b*, the inner 13 and outer 14 slopes each have a slope converging into the groove 15, which forms a particularly effective guiding structure for the peripheral edge 11.

Alternatively, as shown in particular in FIGS. 8*b*, 9*b*, 10*a* and 10*b*, the inner 13 and outer 14 bearing surfaces both extend axially.

The peripheral edge 11 has an inner lip 11*a* arranged to come into sealing contact into the groove 15 at least on each of the bearing surfaces 13, 14, said lip having two convergent inner and outer slopes arranged to slide respectively against the inner bearing surface 13 and the outer bearing surface 14 when placed in said groove.

Advantageously, the ring 10 and the peripheral edge 11 are arranged to allow said edge to come into sealing contact with the ring 10 in three areas, namely the bottom of the groove 15 and each of the bearing surfaces 13, 14, said areas extending generally in two directions, namely radially for the bottom and axially for said bearing surfaces. Thus, the peripheral edge 11 does not need to compress the ring 10, which makes it possible to ensure a good seal for the total period of preparation of the beverage, and in particular as soon as the capsule is enclosed in the cavity 7.

In FIGS. 7*a*, 7*b*, 10*a* and 10*b*, the peripheral edge 11 also comprises an outer lip 11 b arranged to bear in a sealing manner on the bearing surface 19, in particular essentially radially, formed on the free lower face 10*b* outside the groove 15, which makes it possible to form an additional barrier against any leakage of liquid beyond the baffle formed by the groove 15, the walls 13, 14 and the inner lip 11*a*.

Figure 10A:
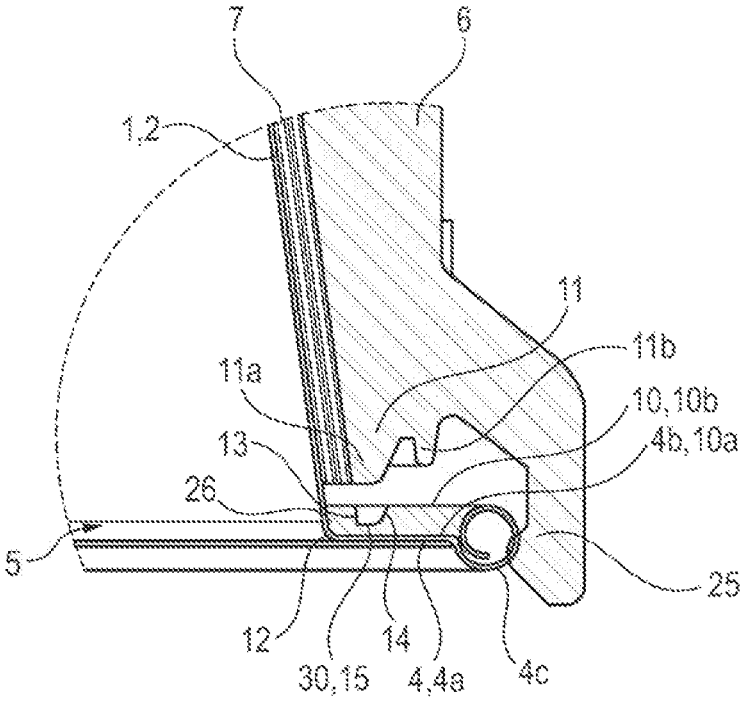
FIGS. 10*a* and 10*b* represent, in partial axial cross-section centred on the rim, two steps of the arrangement of the peripheral edge of a piston on a sealing ring fitted to the capsule of FIGS. 8*a,* 8*b* and 8*c.*
Figure 10B:
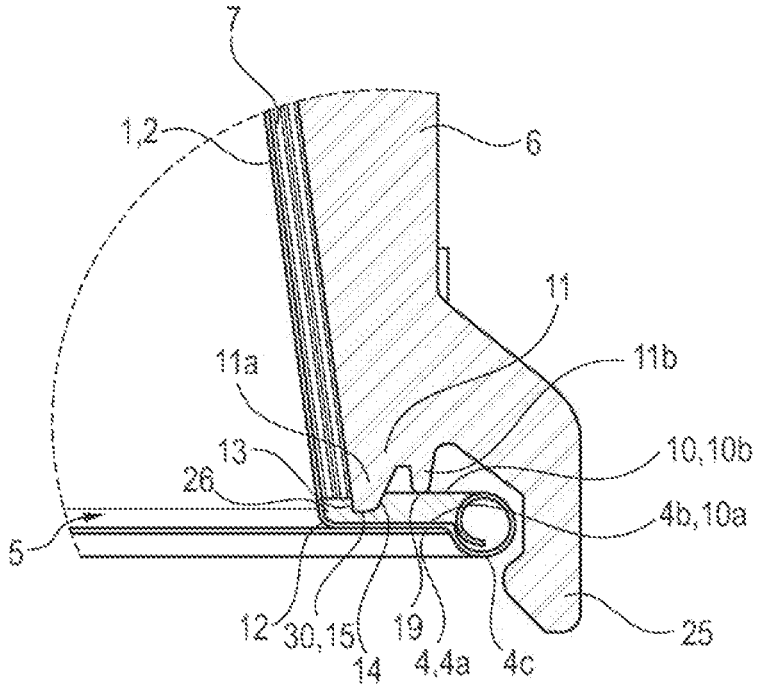

Furthermore, in FIGS. 10*a* and 10*b*, the peripheral edge 11 is extended externally by a hook 25 extending substantially axially, said hook being designed to engage underneath the bead 4*c* to ensure that the capsule 1 is wedged in the cavity 7, and thus to place the groove 15 axially opposite said peripheral edge.

FIGS. 2*a*, 2*b*, 5*a*, 5*b*, 6*a* and 6*b* represent a first embodiment of the invention, in which at least the outer bearing surface 14 is formed on an inner wall of a crown 16*b* projecting from the free lower face 10*b* of the sealing ring 10.

In FIGS. 1, 1*a*, 2*a* and 2*b*, the lateral wall 2 of the body 1 is in the form of a truncated cone with a straight generatrix between the upper portion 3*b* of the bottom and the rim 5, and forms an angle β of approximately 7.5° with the axis of revolution X.

Furthermore, the ring 10 comprises two crowns, an inner crown 16*a* and outer crown 16*b* respectively, each formed in one piece on the free lower face 10*b* of said ring and spaced apart radially to form the groove 15, the outer bearing surface 14 being formed on an inner wall of the outer crown 16*b* and the inner bearing surface 13 being formed on an outer wall of the inner crown 16*a*.

In FIGS. 3, 4, 4*a*, 5*a*, 5*b*, 6*a* and 6*b*, the lateral wall 2 of the body 1 has an upper portion 2*a* from which the rim 4 extends laterally, the inner bearing surface 13 being formed on an outer wall of said upper portion.

Figure 4:
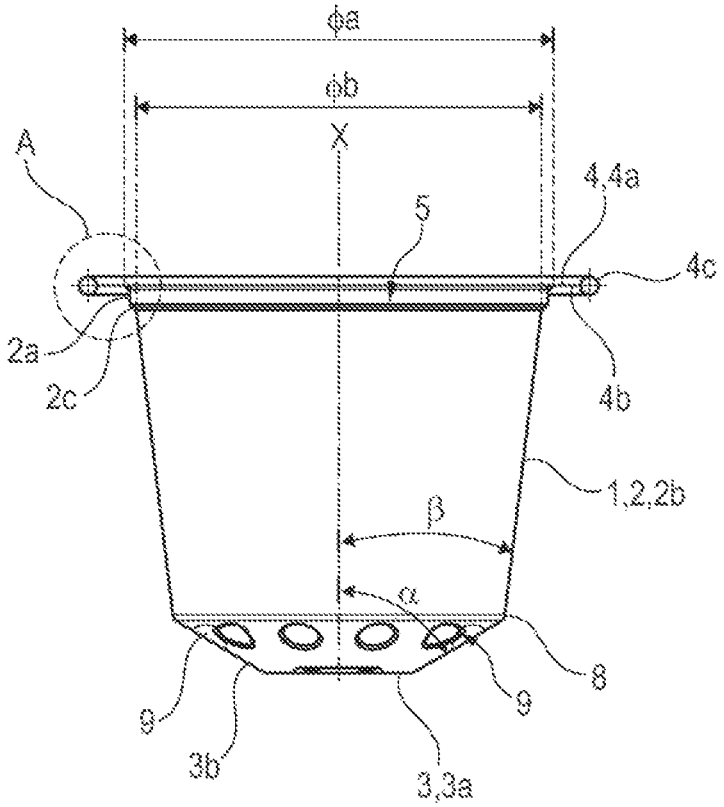
FIGS. 4 and 4*a* represent the capsule of FIG. 3 according to similar views to those of FIG. 1 and FIG. 1*a* respectively.
Figure 4A:
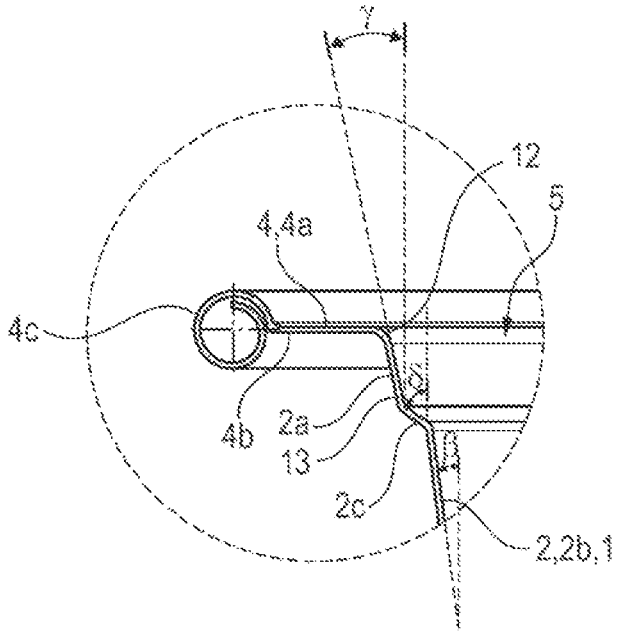
Figure 5A:
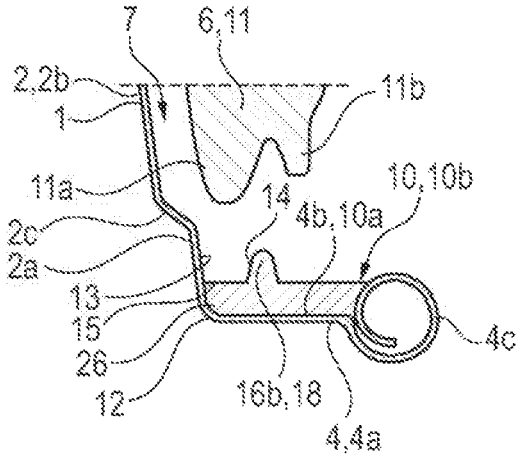
FIGS. 5*a* and 5*b* represent, according to similar views to those of FIGS. 2*a* and 2*b* respectively, two steps of the arrangement of the peripheral edge of a piston on a sealing ring according to a variant of the first embodiment of the invention, said ring being fitted onto the capsule of FIGS. 3, 4 and 4*a;*
Figure 5B:
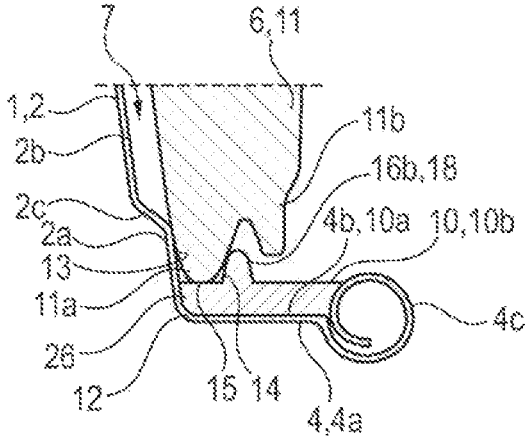

As shown in particular in FIG. 4, the lateral wall 2 has a lower portion 2*b* extending from the conical portion 3*b* of the bottom 3, the upper portion 2*a* extending in the continuity of said lower portion having an outer dimension ϕa which is greater than the outer dimension ϕb of said lower portion.

Thus, the outer dimension ϕb allows the peripheral edge 11 to have sufficient radial clearance at the level of the lower portion 2*b* so as to be able to be guided towards the groove 15. Furthermore, the outer dimension ϕa makes it possible to radially approach the inner bearing surface 13 to the outer bearing surface 14 in order to ensure the radial clamping of the peripheral edge 11 against said inner bearing surface when it is placed in the groove 15.

Advantageously, the lower portion 2*b* and upper portion 2*a* have a truncated cone geometry each having substantially the same tapering angle β, γ, so as to form two similar slopes to facilitate guiding the peripheral edge 11 into the groove 15.

Furthermore, the upper portion 2*a* and lower portion 2*b* are connected by a slope 2*c* with a truncated cone geometry which is formed in the lateral wall, the respective tapering angles γ, β of said portions being smaller than the tapering angle δ of said slope. Thus, the slope 2*c* makes it possible to radially offset the upper portion 2*a*, and therefore the inner bearing surface 13, as close as possible to the outer bearing surface 14, which makes it possible to limit the radial dimension of the groove 15 and improve the sealing of the contact with the peripheral edge 11.

In particular, the tapering angles β, γ of the lower portion 2*b* and the upper portion 2*a* respectively may be between 7° and 11°, the angle δ of the slope 2*c* being in the order of 55°.

Figure 6A:
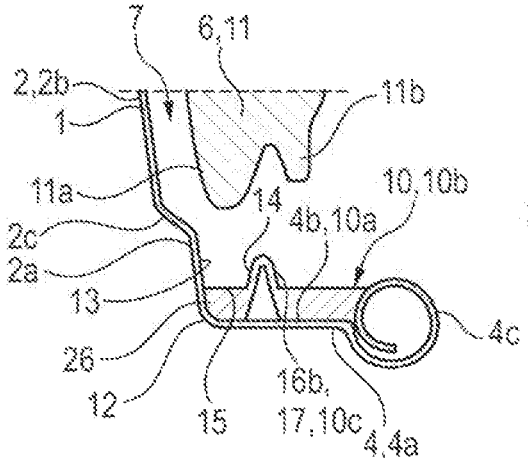
FIGS. 6*a* and 6*b* are similar views to those of corresponding FIGS. 5*a* and 5*b,* with a sealing ring according to another variant of the first embodiment of the invention.
Figure 6B:
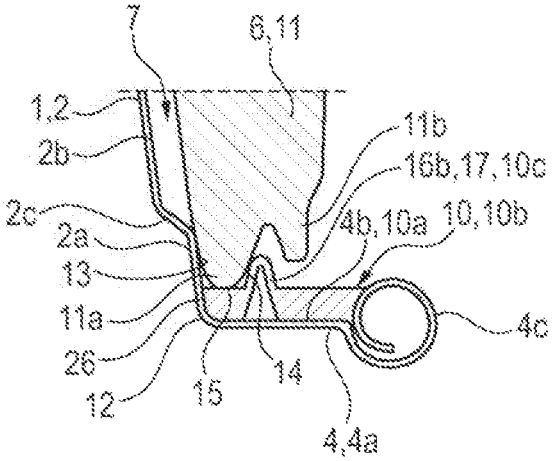

At least one crown 16*a*, 16*b* may be formed by a fold 17 formed in the material forming the ring 10. In FIGS. 6*a* and 6*b*, the ring 10 comprises a single crown 16*b* formed by a fold 17 in a central area 10*c* of said ring, said central area having a reduced thickness so as to facilitate the formation of said fold.

At least one crown 16*a*, 16*b* may also be formed by a thickened part 18 in the material forming the ring 10, as shown in FIGS. 2*a*, 2*b*, 5*a* and 5*b*.

FIGS. 7*a*, 7*b*, 8*a*, 8*b*, 8*c*, 9*a*, 9*b*, 9*c*, 10*a* and 10*b* represent a second embodiment of the invention, in which the sealing ring 10 has a recess 30 formed in the free face 10*b*, at least the outer bearing surface 14 being formed on an inner wall delimiting said recess.

The recess 30 is formed in particular by embossing on the free surface 10*b* of the ring 10. According to one embodiment, the ring 10 has a radial thickness in the order of 0.50 mm, the recess 30 having a depth in the order of 0.35 mm and a radial dimension in the order of 0.55 mm.

Figure 2A:
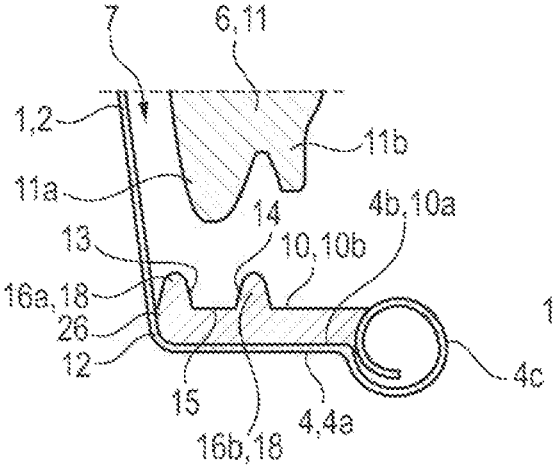
FIGS. 2*a* and 2*b* represent, in a view similar to that of FIG. 1*a,* two steps of the arrangement of the peripheral edge of a piston on a sealing ring according to a first embodiment of the invention, said ring fitting the capsule of FIGS. 1 and 1*a;*
Figure 2B:
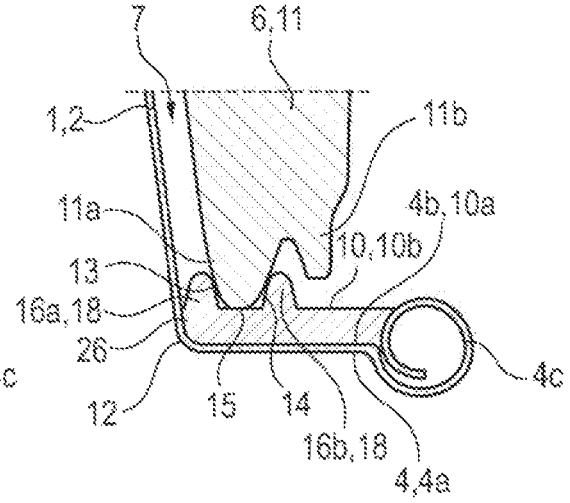
Figure 3:
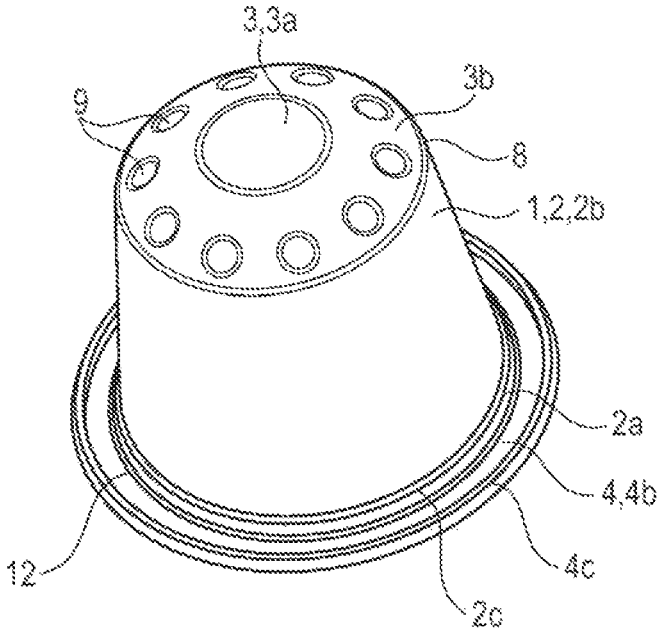
FIG. 3 represents in perspective view from below a capsule according to one embodiment variant of the invention.

In FIGS. 8*a*, 8*b*, 8*c*, 9*a*, 9*b* and 9*c*, the capsule has a similar structure to that of FIGS. 1, 2*a* and 2*b*, and the recess 30 is delimited between two walls which form respectively the inner bearing surface 13 and the outer bearing surface 14, which are spaced apart radially and delimit the groove 15 between them. In particular, the inner bearing surface 13 and outer bearing surface 14 are each inscribed in a diameter in the order of 305 mm and 316 mm respectively.

Figure 7A:
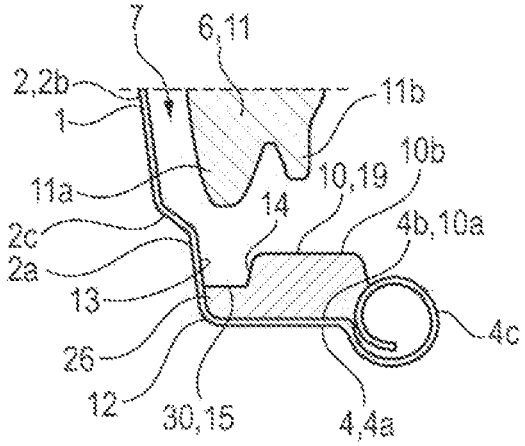
FIGS. 7*a* and 7*b* are similar views to those of the corresponding FIGS. 5*a* and 5*b,* in which the capsule of FIGS. 3, 4 and 4*a* is equipped with a sealing ring according to a second embodiment of the invention.
Figure 7B:
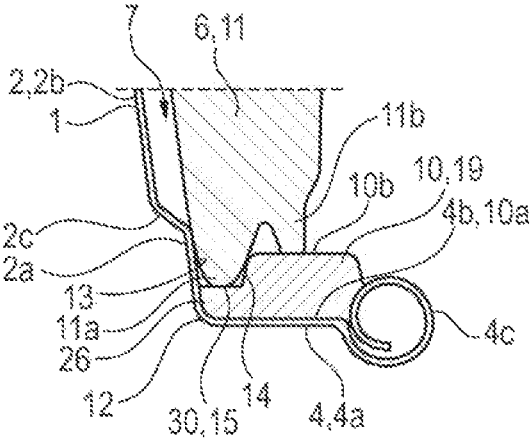

In FIGS. 7*a* and 7*b*, the capsule has a similar structure to that of FIGS. 3, 4, 4*a*, 5*a*, 5*b*, 6*a* and 6*b*, and only the outer bearing surface 14 is formed in one piece in the ring 10, the inner bearing surface 13 being formed on an outer wall of the upper portion 2*a* of the capsule.

The sealing ring 10 may further comprise an inner periphery 26 which is surrounded by the groove 15, said inner periphery 26 bearing against the lateral wall 2 of the body 1.

In particular, the inner periphery 26 has teeth 21 angularly distributed and spaced apart by notches 20, said teeth defining an inner dimension which is smaller than the outer dimension of the lateral wall 2, so as to ensure the clamping of the ring 10 around said lateral wall.

Figure 8A:
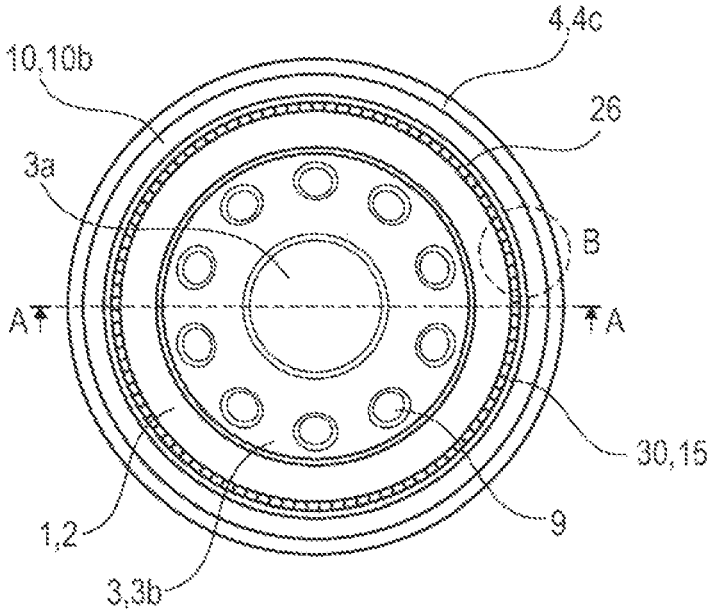
FIGS. 8*a,* 8*b* and 8*c* represent a capsule fitted with a sealing ring according to one embodiment variant of FIGS. 7*a* and 7*b,* respectively in a view from below (FIG. 8*a*), in partial cross-section along the axis A-A centred on the rim (FIG. 8*b*) and according to an enlargement of area B of FIG. 8*a* (FIG. 8*c*)
Figure 8B:
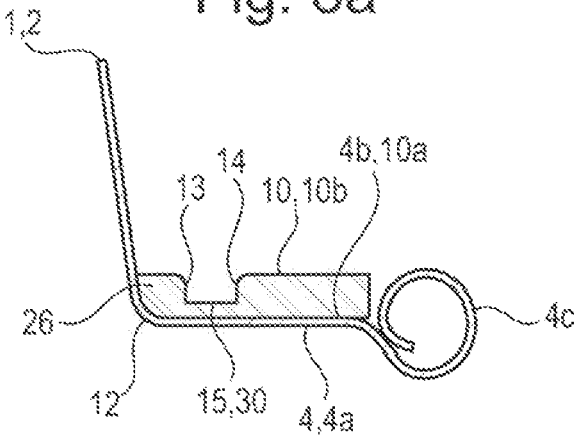
Figure 8C:
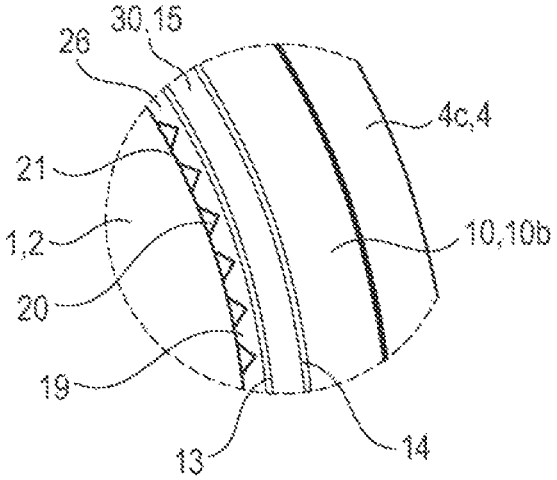

In FIGS. 8*a* and 8*c*, the teeth 21 have a tapered distal end which can be deformed when bearing on the lateral wall 2, which makes it possible to increase the dimension of the bearing surface between the inner periphery 26 and said wall, and therefore guarantee the clamping of the ring 10 around said wall.

Figure 9A:
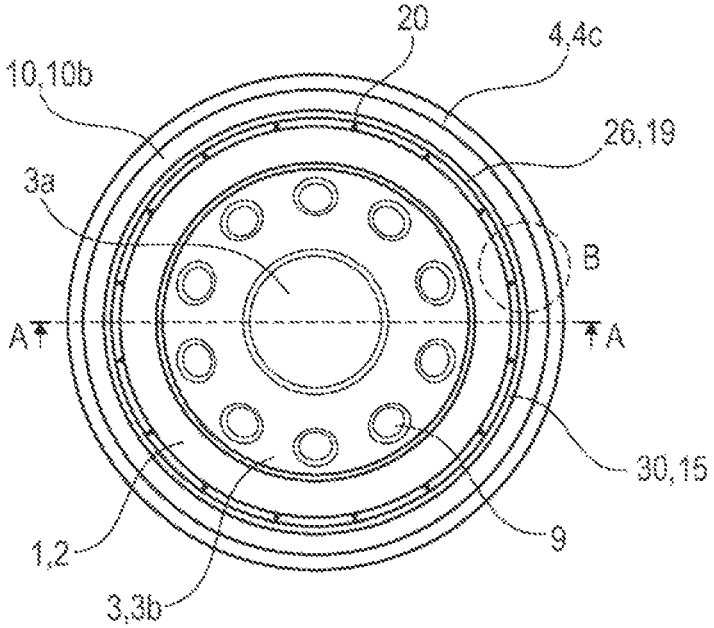
FIGS. 9*a,* 9*b* and 9*c* are similar views to those of corresponding FIGS. 8*a,* 8*b* and 8*c,* with a sealing ring according to a variant of the second embodiment of the invention.
Figure 9B:
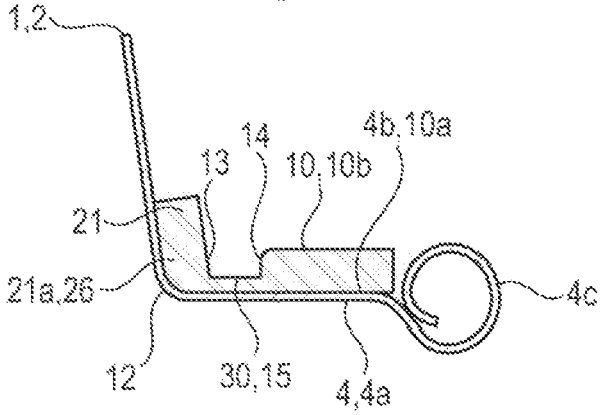
Figure 9C:
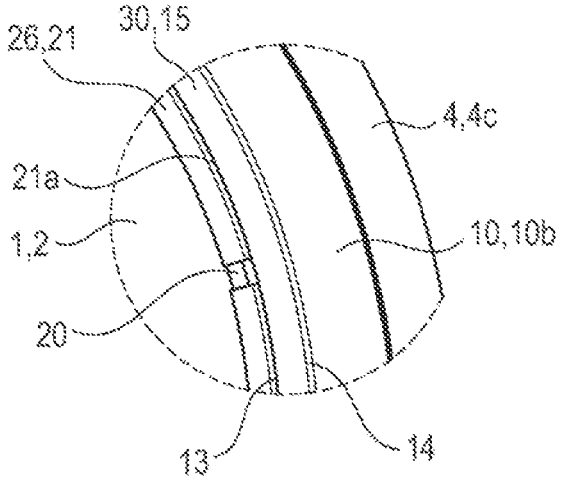

In FIGS. 9*a* and 9*c*, the teeth 21 are arranged so that they can be folded over along the lateral wall 2 by bearing thereon. For this purpose, the teeth 21 have a base 21*a* which can bend during the folding over.

In particular, the teeth 21 are formed in the inner radial extension of the inner periphery 26, which thus forms the base 21*a* of said teeth, so as to allow the bending of the ring 10 at the inner bearing surface 13 when placed around the lateral wall 2.

What is claimed is:

1. A capsule intended for containing a substance for preparing a beverage by placing the capsule in the cavity of a piston, the capsule comprising a body with a lateral wall bordered on either side by a bottom and by a rim surrounding an opening of the body, the rim having a lower wall projecting laterally from the lateral wall, the rim is connected to the lateral wall by a rounded transition, the capsule being fitted with a single one-piece sealing ring attached to the lower wall, the sealing ring having an upper face bearing on the lower wall and a free lower face, the sealing ring also having an inner periphery which is arranged bearing against the rounded transition of the lateral wall, the capsule having an inner bearing surface and an outer bearing surface each projecting from the rim in an axial direction, forming therebetween a groove that is arranged to sealingly receive the peripheral edge of the piston in a sealing manner during the preparation of the beverage, at least the outer bearing surface being formed in one piece on the free lower face of the sealing ring.

2. The capsule according to claim 1, wherein the sealing ring is made based on biodegradable and/or compostable material.

3. The capsule according to claim 1, wherein the sealing ring is made based on an absorbent material.

4. The capsule according to 1, wherein the sealing ring is made based on a cellulose material.

5. The capsule according to claim 1, wherein the body is made from a metal material.

6. The capsule according to claim 1, wherein at least one of the inner bearing surface or outer bearing surface has a slope converging into the groove.

7. The capsule according to claim 1, wherein at least the outer bearing surface is formed on an inner wall of a crown which projects from the free lower face of the sealing ring.

8. The capsule according to claim 7, wherein the ring comprises two crowns, an inner crown and an outer crown respectively, each formed in one piece on the free lower face of the ring, being spaced apart radially and forming the groove between them, the outer bearing surface being formed on an inner wall of the outer crown and the inner bearing surface being formed on an outer wall of the inner crown.

9. The capsule according to claim 7, wherein at least one crown is formed by a thickened part in the material forming the ring.

10. The capsule according to claim 7, wherein at least one crown is formed by a fold made in the material forming the ring.

11. The capsule according to claim 1, wherein the sealing ring has a recess formed into the free lower face, at least the outer bearing surface being formed on an inner wall delimiting the recess.

12. The capsule according to claim 11, wherein the recess is delimited between two walls respectively forming the inner bearing surface and the outer bearing surface which are spaced apart radially by delimiting the groove between them.

13. The capsule according to claim 1, wherein the lateral wall of the body has an upper portion from which the rim extends laterally, the inner bearing surface being formed on an outer wall of said upper portion.

14. A system for preparing a beverage having a capsule according to claim 1 which contains a substance for preparing the beverage, the system comprising a piston which has a cavity for receiving the capsule, the cavity comprising a device arranged to inject under pressure an extracting liquid of the beverage through the capsule, and a peripheral edge arranged to be placed in a sealed manner in the groove formed between the outer bearing surface and inner bearing surface.

15. The system according to claim 14, wherein the peripheral edge comprises a lip arranged to come into sealing contact with the groove at least on each of the bearing surfaces.

16. A capsule intended for containing a substance for preparing a beverage by placing the capsule in the cavity of a piston, the capsule comprising a body with a lateral wall bordered on either side by a bottom and by a rim surrounding an opening of the body, the rim having a lower wall projecting laterally from the lateral wall, the capsule being fitted with a sealing ring attached to the lower wall the sealing ring having an upper face bearing on the lower wall and a free lower face, the capsule having an inner bearing surface and an outer bearing surface each projecting from the rim in an axial direction, forming therebetween a groove that is arranged to sealingly receive the peripheral edge of the piston in a sealing manner during the preparation of the beverage, at least the outer bearing surface being formed in one piece on the free lower face of the sealing ring;

wherein the sealing ring comprises an inner periphery which is arranged bearing against the lateral wall of the body, the inner periphery has angularly distributed teeth spaced apart by notches, the teeth defining an inner dimension which is smaller than the outer dimension of the lateral wall to ensure a clamping of the ring around the lateral wall.

17. The capsule according to claim 1, wherein the sealing ring is joined to the rim by fusing.

18. The capsule according to claim 17, wherein the sealing ring comprises a fusible coating arranged on its upper face to join the ring to the rim.

19. The capsule according to claim 1, wherein the sealing ring comprises a self-adhesive strip arranged on its upper face to join the ring to the rim.

20. A capsule intended for containing a substance for preparing a beverage by placing the capsule in the cavity of a piston, the capsule comprising a body with a lateral wall bordered on either side by a bottom and by a rim surrounding an opening of the body, the rim having a lower wall projecting laterally from the lateral wall, the rim is connected to the lateral wall by a rounded transition, the capsule being fitted with a single one-piece sealing ring attached to the lower wall, the sealing ring having an upper face abutting the length of the lower wall and a free lower face, the sealing ring also having an inner periphery which is arranged bearing against the rounded transition of the lateral wall, the capsule having an inner bearing surface and an outer bearing surface each projecting from the rim in an axial direction, forming therebetween a groove that is arranged to sealingly receive the peripheral edge of the piston in a sealing manner during the preparation of the beverage, at least the outer bearing surface being formed in one piece on the free lower face of the sealing ring.

* * * * *